US005574617A

United States Patent [19]

Shimanuki et al.

[11] Patent Number: 5,574,617

[45] Date of Patent: Nov. 12, 1996

[54] FUEL INJECTION VALVE DRIVE CONTROL APPARATUS

[75] Inventors: Hiroshi Shimanuki; Toshiaki Ariyoshi, both of Saitama-ken, Japan

[73] Assignee: Honda Giken Kogyo Kabushiki Kaisha, Tokyo, Japan

[21] Appl. No.: 352,560

[22] Filed: Dec. 9, 1994

[30] Foreign Application Priority Data

Dec. 28, 1993 [JP] Japan ..... 5-350739

[51] Int. Cl.[6] ..... H01H 47/04

[52] U.S. Cl. ..... 361/154

[58] Field of Search ..... 361/152–155, 361/159; 123/490

[56] References Cited

U.S. PATENT DOCUMENTS

| | | | |
|---|---|---|---|
| 4,180,026 | 12/1979 | Schülzke et al. . | |
| 4,949,215 | 8/1990 | Studtmann et al. | 361/154 |
| 5,134,537 | 7/1992 | Buss et al. | 361/154 |

FOREIGN PATENT DOCUMENTS

| | | |
|---|---|---|
| 56-58826 | 5/1981 | Japan . |
| 56-94412 | 7/1981 | Japan . |
| 58-51233 | 3/1983 | Japan . |
| 63-55345 | 3/1988 | Japan . |

*Primary Examiner*—Fritz Fleming

*Attorney, Agent, or Firm*—Pollock, Vande Sande & Priddy

[57] ABSTRACT

A fuel injection valve drive control apparatus in which an opening current is supplied to an excitation coil to open an electromagnetic fuel injection valve, and thereafter a holding current is supplied to keeping the valve open, comprising a first switch connected in series with the coil, a valve driver for controlling conduction of the first switch, and a flywheel circuit and a second switch in parallel with the coil. The second switch is turned on a predetermined time following the start of supply of the holding current. A timer, provided to measure the predetermined time, starts clocking in response to the supply of the holding current or the valve opening current, or turning off of the first switch. The activation time of the second switch is shortened, whereby power consumption is reduced.

5 Claims, 3 Drawing Sheets

FUEL INJECTION VALVE DRIVE CONTROL APPARATUS

BACKGROUND OF THE INVENTION

1. Field of the Invention

The present invention is related to a fuel injection valve drive control apparatus, and particularly to a fuel injection valve drive control apparatus which controls an driving of the electromagnetic valve used in the fuel injection system of an internal combustion engine.

2. Description of the Prior Art

Generally, in an electromagnetic fuel injection valve system, as shown in FIG. 3, a plunger 2 is urged into abutment with a tapered fuel injection port 1 by a spring 3 thereby to maintain the value in a closed state. When a current is applied to a coil L surrounding the plunger 2, the plunger 2 is attracted and moves in the direction of an arrow "a" against the spring force of the spring 3 to open the valve. As a result, fuel is injected through the gap between the plunger 2 and the fuel injection port 1. Thus, in the prior art fuel injection valve, since the injection valve opens only for the period of time of a pulse current provided to the coil L, control of the fuel injection amount is performed by controlling the width of the pulse current.

In such a construction, even if the pulse current is supplied to the coil L at the time of valve opening, the valve does not open until a force overcoming the spring force acts on the plunger 2, and hence a time delay will occur. In addition, even if the fuel injection pulse turns off at the time of valve closing, the plunger 2 does not promptly return because of the residual magnetic flux in the plunger 2. Accordingly, such a fuel injection valve inherently has the problem that it is difficult to accurately control the injection amount in response to a fuel injection pulse used for opening the value.

To deal with such problem, it has been proposed, as shown in FIG. 4, that during the ON duration of the fuel injection pulse, a relatively large excitation current (valve open current) is caused to flow at the initial stage of valve opening to achieve a prompt valve opening operation, and once the valve opens, only a minimum excitation current (holding current) required for keeping the valve open is supplied to reduce the residual magnetic flux present when the coil current decreases to close the value. Further, to efficiently absorb the energy stored in the coil of the electromagnetic valve when the holding current is shut off, an apparatus provided with a so-called flywheel circuit is proposed, for instance, in the Japanese Patent Laid-open Nos. 51-125932 and 57-203830 official gazettes.

FIG. 5 is a circuit diagram showing the main portions of a fuel injection valve drive control apparatus including a flywheel circuit, and FIG. 6 is a waveform diagram of the driving signals thereof. One end of an electromagnetic coil L is connected to the emitter of a transistor $Q_1$, and a battery voltage $V_B$ is applied to the collector of the transistor $Q_1$. The other end of the coil L is grounded through a resistor R. In parallel with the coil L and the resistor R, a transistor $Q_2$ and a diode D constituting the flywheel circuit are connected in series.

When a pulse signal (c) of FIG. 6 for chopping control is input to the base of the transistor $Q_1$ in response to an fuel injection pulse (a), the transistor $Q_1$ turns on, and an excitation current $I_L$ begins to flow through the coil L and gradually increases with a first-order time-lag as shown in (b) of the same figure.

When the excitation current $I_L$ reaches a valve-opening current $I_1$ necessary for opening the closed electromagnetic valve and attraction of the plunger 2 is completed, the control pulse (c) falls down to an "L"-level, the transistor $Q_1$ turns off, and the current $I_L$ of the coil L begins to decrease. When the excitation current $I_L$ falls to a lower limit value $I_2$ of the holding current, the transistor $Q_1$ again turns on and the excitation current $I_L$ starts to flow, and when the excitation current $I_L$ reaches the upper limit value $I_3$ of the holding current, the transistor $Q_1$ again turns off. Thereafter, such intermittent control of the transistor $Q_1$ is repeated while the fuel injection pulse (a) is at a "H"-level, whereby the excitation current $I_L$ is maintained at a minimum current value (holding current) required for attracting and holding the plunger 2.

Since the transistor $Q_2$ is controlled so that it turns on simultaneously with the leading edge of the injection pulse (a) as in FIG. 6(*d*), or simultaneously with the first turn-off of the transistor $Q_1$ as in (e) of FIG. 6, the energy stored in the coil L is absorbed in the flywheel diode D each time the transistor $Q_1$ is turned off.

This prior art apparatus had a problem that the base current should be continuously supplied to the transistor $Q_2$ to activate the flywheel circuit for a relatively long time, resulting in large power consumption.

SUMMARY OF THE INVENTION

It is the object of the present invention to provide a fuel injection valve drive control apparatus in which power consumption is reduced by delaying the activation timing of a flywheel circuit to shorten the activation time thereof.

The present invention is a fuel injection valve drive control apparatus in which a valve opening current sufficiently large to open an electromagnetic fuel injection valve consisting of a plunger engaged with a fuel injection port and an excitation coil surrounding the plunger is supplied to the coil to open the valve, and thereafter a holding current required for keeping the valve open is supplied to the coil instead of the valve opening current, comprising a first solid state switch element connected in series with the excitation coil for controlling the current supply to the coil, a valve driver means for performing the on-off control of the first solid state switch element to supply the valve opening current or the holding current to the coil, a means connected in parallel with the coil through a second solid state switch element, which when the first solid state switch is turned off, feeds back the electromagnetic energy stored in the coil to the coil through the second solid state switch element, and a means for turning on the second solid state switch element after the elapse of a predetermined time following the start of supplying the holding current.

In an embodiment of the present invention, a timer means is provided for measuring the predetermined time mentioned above, and the means for turning on the second solid state switch element causes the second solid state switch element to turn on in response to the elapse of the predetermined time.

In an other embodiment, a timer means is provided for measuring a time duration that is the sum of the predetermined time and a first additional time period between the start of supply of the valve open current and the start of supply of the valve holding current. The second solid switch element is turned on in response to completion of said sum time duration.

Still other embodiments of the present invention include a first current detector means for detecting that the current in the coil has increased to a value required for opening the valve, and a second current detector means for detecting that the current in the coil has decreased to a holding current required for keeping the valve open. A timer means begins to measure a time duration that is the sum of the predetermined time and a second additional time period between the generating of an output from the first current detector means, and the generating of a first output from the second current detector means after the output generated by the first current detector means.

The second solid state switch is turned on in response to the completion of time measurement by the timer.

In accordance with the present invention, the second solid state switch for activating the flywheel circuit is turned on for the first time and the flywheel circuit is activated after a predetermined time has elapsed since the coil current has decreased to the holding current for the first time after the coil current increased to the valve opening current, in other words, since the holding current supply has started instead of the valve opening current. Consequently, the energization time of the flywheel circuit or the second solid state switch is shortened as compared with a case where the flywheel circuit is enabled simultaneously with the start of supplying the valve opening current, or simultaneously with the actual valve opening by supply of the valve opening current to the coil, as in the prior art. Thus, the power consumption in the flywheel circuit can be reduced, whereby power consumption in the fuel injection valve driving system is reduced.

DETAILED DESCRIPTION OF THE PREFERRED EMBODIMENT

Figure 1:
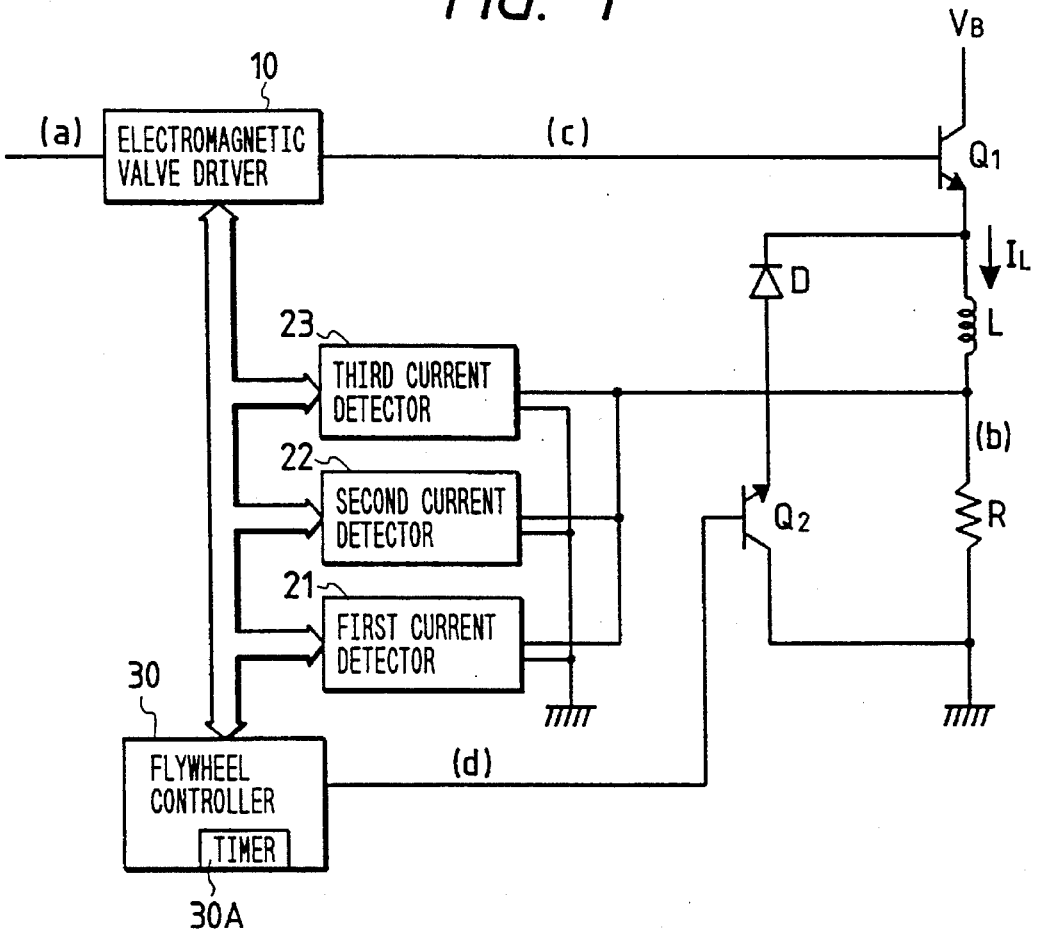
FIG. 1 is a block diagram of the main portions of an embodiment of the present invention.
Figure 5:
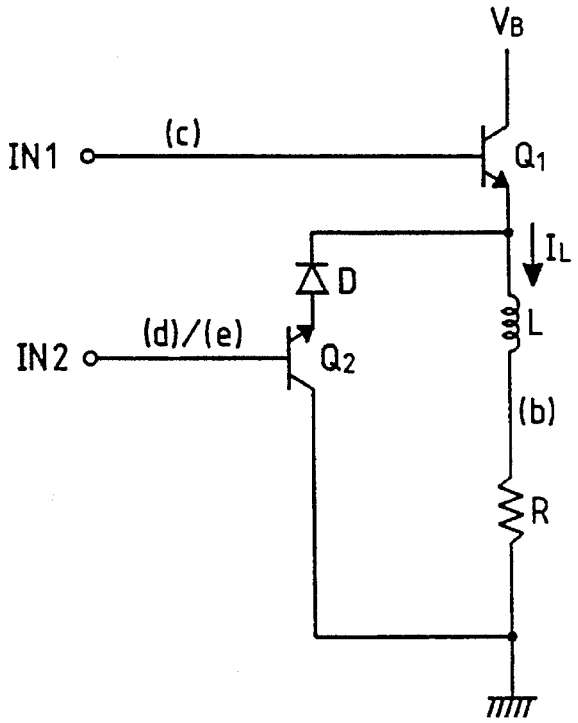
FIG. 5 PRIOR ART
FIG. 5 is a circuit diagram of the main portions of a conventional fuel injection valve drive control apparatus including a flywheel circuit.

The present invention is described in detail with reference to the drawings. FIG. 1 is a block diagram showing the construction of the main portions of the fuel injection valve control apparatus which is an embodiment of the present invention, and in the figure, the same symbols as FIG. 5 represent the same or identical portions.

An electromagnetic valve driver 10 performs on-off control of a solid state switch element, for instance, a transistor $Q_1$, to control the excitation current $I_L$ of a coil. A resistor R is connected between the coil L and ground, and the current in the coil L can be detected based on the voltage drop across the resistor. A first current detector 21 generates a control signal and changes the output of the electromagnetic valve driver 10 to an "L"-level when it detects that the excitation current $I_L$ has reached a valve opening current value $I_1$. A second current detector 22 detects that the excitation current $I_L$ has reached a lower limit value $I_2$ during its falling process, and then generates a control signal to change the output of the electromagnetic valve driver 10 to a "H"-level. A third current detector 23 changes the output of the electromagnetic valve driver means 10 to an "L"-level when it detects that the excitation current $I_L$ has reached an upper limit value $I_3$ of the holding current in its rising process after the first or second current detector 21 or 22 generates the control signal. A flywheel control means 30 turns on a solid state switch element, such as a transistor $Q_2$, after the elapse of a predetermined time following the detection of the increase of the excitation current $I_L$ to $I_1$ in response to the rise of a fuel injection pulse (a).

Figure 2:
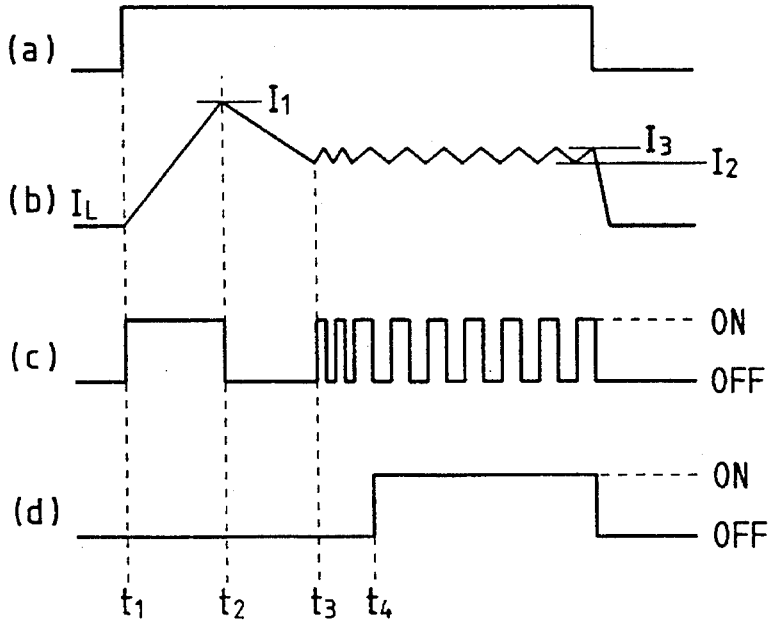
FIG. 2 is a waveform diagram of the driving signals for the main portions in FIG. 1.
Figure 3:
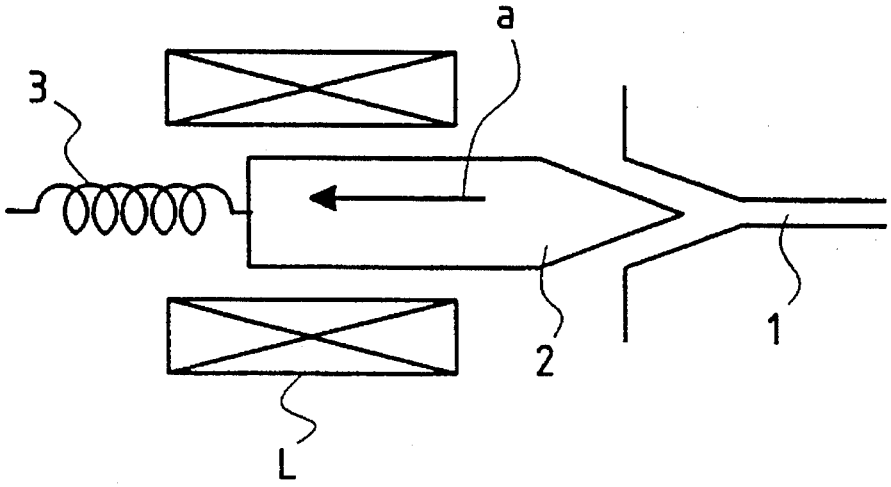
FIG. 3 PRIOR ART
FIG. 3 is a schematic diagram of a prior art electromagnetic fuel injection valve system.
Figure 4:
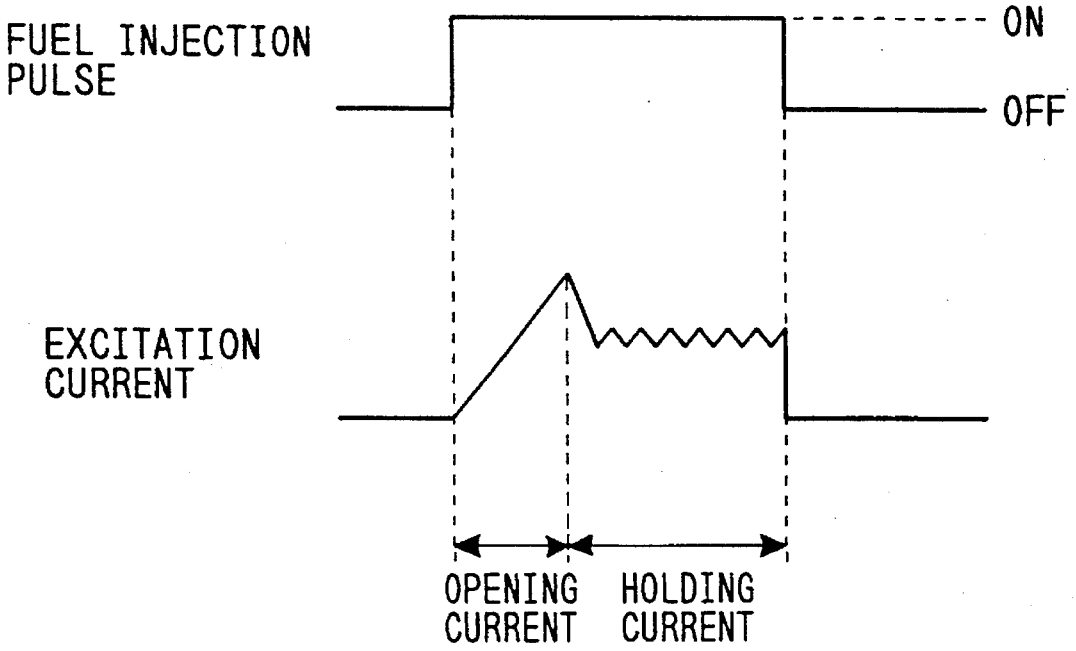
FIG. 4 PRIOR ART
FIG. 4 is a waveform diagram of the fuel injection pulse and the excitation current of the coil in FIG. 3.

FIG. 2 is a signal waveform for the main portions of FIG. 1. When the fuel injection pulse (a) rises at time t1, the pulse signal (c) is output from the driver 10 to turn on the transistor $Q_1$, and the excitation current $I_L$ begins to flow in the coil L as shown in FIG. 2(*b*). On the other hand, in the flywheel control means 30, an internal timer 30A starts simultaneously with the rise of the fuel injection pulse (a).

When the excitation current $I_L$ increases and Peaches the valve opening current $I_1$ at time t2, the electromagnetic valve opens to start the fuel injection, and simultaneously the first current detector 21 detects this and outputs a control signal to the driver 10 and the flywheel control 30. Since the output of the driver 10 becomes an "L"-level in response to the control signal, the transistor $Q_1$ turns off to cause the excitation current $I_L$ to decrease.

Thereafter, when the excitation current $I_L$ reaches the lower limit value $I_2$ of the holding current at time t3, the second current detector 22 detects this and outputs a second control signal to the driver 10. In response to this control signal, the output of the driver 10 again becomes a "H"-level, and the transistor Q1 turns on again to cause the excitation current $I_L$ to increase. When the excitation current $I_L$ reaches an upper limit value $I_3$ of the holding current, the third current detector 23 detects this to turn off the transistor $Q_1$. As well known, the upper limit value $I_3$ is preferably as small as possible so long as the valve is kept open, and it depends on the duty ratio of the pulse signal output from the driver 10. Thereafter, such control is repeated while the fuel injection pulse (a) is at a "H"-level, and the excitation current $I_L$ is kept at a minimum current value (holding current) needed for attracting the plunger to maintain the valve open.

On the other hand, at time t4 when the internal timer 30A in the flywheel control means 30 completes the clocking of a predetermined time (t4–t1), the output of the flywheel control means 30 becomes "H"-level as shown in FIG. 2(*d*) and the transistor $Q_2$ turns on. Thereafter, every time the transistor $Q_1$ turns off, the energy stored in the coil L during the conduction of transistor $Q_1$ is fed back to the coil l through the transistor $Q_2$ and the diode D.

Figure 6:
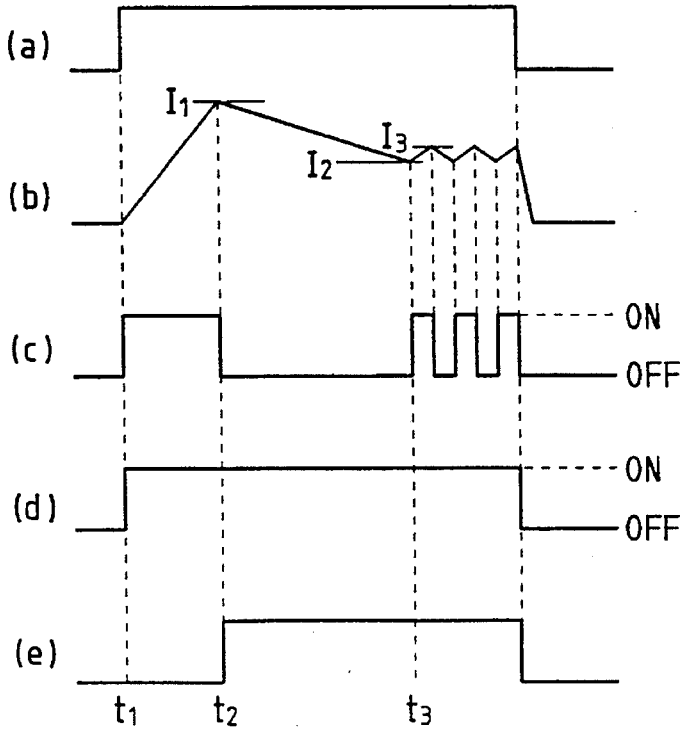
FIG. 6 PRIOR ART
FIG. 6 is a waveform diagram of the driving signals for the main portions in the circuit of FIG. 5.

In accordance with this embodiment, as compared with the case in which activation of the flywheel circuit is begun simultaneously with the rise of the fuel injection pulse (a) as shown in FIG. 6(*d*), the activation period can be shortened by (t4–t1). Further, as compared with the case in which the activation is started at the time when the transistor $Q_1$ turns off for the first time (corresponding to t2 in FIG. 2) as shown in FIG. 6(*e*), the activation period can be shortened by (t4–t2). In consequence, the base current of the transistor $Q_2$ can be shut off for the period of time that is shortened, whereby power consumption can be reduced.

In the above embodiment, the description was made on the assumption that the timer 30A in the flywheel control means 30 starts the clocking simultaneously with the rise of the fuel injection pulse (a) at time t1, but the clocking may be started at a time (t2) when the transistor $Q_1$ turns off for the first time after the valve opening is completed. Alternatively, the clocking of a predetermined time may be started at a time (t3) when the coil current decreases to the holding current for the first time after the valve is opened.

As described above, in accordance with the fuel injection valve drive control apparatus of the present invention, the switching means for enabling the flywheel circuit is activated following elapse of a predetermined time after the coil current is switched from the valve opening current to the holding current, and thus the activation time of the switching means is shortened, whereby power consumption can be reduced.

What is claimed is:

1. A fuel injection valve drive control apparatus in which a valve opening current that is large enough to open an electromagnetic fuel injection valve, consisting of a plunger movable relative to a fuel injection port and an excitation coil surrounding the plunger, is supplied to said coil to open the valve, and thereafter, instead of continuing to supply said valve opening current, a lesser holding current required to keep said valve open is supplied to said coil, the fuel injection valve drive control apparatus comprising:

a first solid state switch element connected in series with said excitation coil for controlling the current supply to said coil, a valve driver for performing on-off control of said first solid state switch element to supply the valve opening current or the holding current to said coil, means, connected in parallel with said coil through a second solid state switch element, operative when said first solid state switch element is turned off after it was turned on, for feeding back to said coil, through said second solid state switch element, electromagnetic energy stored in said coil and means for turning on said second solid state switch element after the elapse of a predetermined time following the start of supplying the holding current.

2. A fuel injection valve drive control apparatus as set forth in claim 1, further comprising a timer for measuring said predetermined time, said means for turning on said second solid state switch element being operative to turn on said second solid state switch element in response to completion of the measuring of said predetermined time by said timer.

3. A fuel injection valve drive control apparatus as set forth in claim 1, further comprising a timer for measuring a time duration that is the sum of said predetermined time plus the time period between the commencement of supplying the valve opening current and the commencement of supplying the holding current, said means for turning on said second solid state switch element being operative to turn on said second solid state switch element in response to completion of the measuring of said sum time duration by said timer.

4. A fuel injection valve drive control apparatus as set forth in claim 1, further comprising a first current detector for providing an output signal when the coil current has increased to a value required for opening the valve, and a timer for measuring a time duration that is the sum of said predetermined time plus the time period between provision of the output signal from the first current detector means and the commencement of supplying of the holding current, said means for turning on said second solid state switch element being operative to turn on said second solid state switch element in response to completion of the measuring of said sum time duration by said timer.

5. A fuel injection valve drive control apparatus as set forth in claim 2, further comprising a first current detector for providing a first output signal when the coil current has increased to a value required for opening the valve, and a second current detector for providing a second output signal when the coil current has decreased to the holding current required for keeping the valve open after the first output signal is provided, said timer being operative to start measuring said predetermined time in response to said second output signal.

* * * * *